US006848221B1

(12) United States Patent
Hartz

(10) Patent No.: US 6,848,221 B1
(45) Date of Patent: Feb. 1, 2005

(54) OVERHANG FALSEWORK

(75) Inventor: Douglas K. Hartz, Clinton, OH (US)

(73) Assignee: The Ruhlin Company, Shron Center, OH (US)

( * ) Notice: Subject to any disclaimer, the term of this patent is extended or adjusted under 35 U.S.C. 154(b) by 54 days.

(21) Appl. No.: 10/286,059

(22) Filed: Nov. 1, 2002

(51) Int. Cl.[7] ..... E04B 1/34
(52) U.S. Cl. ..... 52/73; 248/228.1; 248/250
(58) Field of Search ..... 52/73; 248/235, 248/290.1, 250, 228.1, 228.5, 291

(56) References Cited

U.S. PATENT DOCUMENTS 3,472,475 A * 10/1969 Rudiger ..... 248/228.1 X
3,806,074 A * 4/1974 Ward ..... 248/228.1
3,825,217 A * 7/1974 Fleming ..... 248/205.1
4,660,800 A * 4/1987 Horstketter ..... 249/24
5,104,089 A * 4/1992 Shook et al. ..... 249/211
5,234,188 A 8/1993 McSwain
5,271,596 A 12/1993 Holcomb et al.
5,524,854 A 6/1996 McSwain et al.
6,397,423 B1 * 6/2002 Sessler et al. ..... 14/78
6,715,729 B2 4/2004 Hambelton

* cited by examiner

*Primary Examiner*—Anthony D. Barfield
(74) *Attorney, Agent, or Firm*—Fay, Sharpe, Fagan, Minnich & McKee, LLP

(57) ABSTRACT

An overhang falsework for supporting a debris shield on an outward side of an I-beam used in an overhead frame structure comprises an elongated base member extending in a longitudinal direction transverse to the I-beam between an inner end and an outer end wherein said outer end is on the outward side of the I-beam. The falsework further includes a clamp connected to the member between the inner and outer ends for selectively securing the falsework to the I-beam in an installed condition on the I-beam. The base member has a multi-component construction including a metal component extending between the inner and outer ends and a non-metal or wooden component extending at least partially between the inner and outer ends which is secured to the metal component. The non-metal or wooden layer provides a medium for nailing or screwing a horizontal panel portion or base sheet of the debris shield to the falsework, and the metal layer provides support. The falsework further includes an upwardly extending member that is selectively interengageable with the base member. The upward member supporting a side sheet of the debris shield.

7 Claims, 5 Drawing Sheets

2
2
3
3
4
4
5
5
96
156
152
154
94
170
90
162
M
100
93
98
158
159
164
92
95
176
172
180
182
178
52
48
42
56
46
44
50
80
D
220
224
210
72
124
214
70
78
216
54
10
22
218
108
124
12
110
140
132
106
130
120
214
212
150
144
226
142
148
14
222
220
200
202

OVERHANG FALSEWORK

The present invention relates to the art of overhang falseworks which are used in connection with the construction and/or repair of bridges or highways and, more particularly, to an overhang falsework used to support a debris shield that helps prevent debris from falling over the edges of the bridge or highway structure during the construction or repair thereof.

BACKGROUND OF THE INVENTION

The present invention is particularly applicable for use in connection with an overhang falsework to minimize the debris which falls over an edge portion of a parallel beam bridge structure and therefore the invention will be described with particular reference to such application. However, the invention has broader applications and may be used in connection with other I-beam structures and other types of construction applications.

It is, of course, well known that debris shields can be used in connection with the construction or repair of a bridge structure to help minimize the amount of debris which can fall from the edges of the bridge structure. While debris shields can take many forms and can be used in connection with any portion of the bridge structure, the overhang falsework of this application is particularly applicable to debris shields which are used on the outermost edges of a bridge structure. These types of debris shields are designed to catch any debris which falls from the bridge deck. In order to accomplish this, debris shields known in the art include both a horizontal portion or base sheet and an upwardly extending portion or side sheet. Turning to the side sheet, it is designed to direct horizontally moving debris from the bridge deck downwardly to the base sheet of the debris shield which ultimately captures the debris. The base and side portions extend longitudinally along the edge of the bridge structure corresponding with the area which is under construction. In view of the potential impact of the debris in certain construction and/or repair circumstances, debris shields are made from shock resistant-material which is typically laminated plywood. While the debris shield is not meant to support the weight of a person, construction supplies or equipment, it must be well supported and securely fastened to the bridge frame structure.

The overhang falseworks are attached to the beams of the bridge frame structure and support the base and side portions of plywood of the debris shield. In general terms, the overhang falseworks include a horizontal member having a connecting arrangement to maintain the falsework relative to the bridge frame. The horizontal or base member also supports the base sheet of the debris shield and an upwardly extending member for supporting the side sheet of the debris shield. While the overhang falsework is only designed to support the debris shield and the corresponding debris, it must be a rigid frame structure and must be securely fastened to the framework of the bridge. Furthermore, in view of the cantilever nature of this type of structure, the horizontal member must be robust enough to support the bending moment of the cantilever forces. Due to the temporary nature of a debris shield and corresponding overhang falsework, the framework of the falsework must also be designed for easy installation and removal from the bridge frame structure. If the frame structure of the overhang falsework is not able to be quickly installed and/or removed, the use of the falsework will be cost prohibitive.

Prior art overhang falseworks are sufficient to support both the base and side sheets of the debris shield. However, they are heavy, difficult to handle, and also create an obstruction below the bridge frame structure. Depending on the application, prior art overhang falseworks are made from at least one wooden member or beam which is either a 2"×6" or 2"×8". This wooden beam is secured to the bottom edge of the I-beam bridge frame which also supports the bridge deck. As a result, the overhang falsework can extend between 6 and 10 inches below the bottom edge of the I-beam structure. The wooden beams of prior art falseworks are at least 2"×6" in cross-sectional configuration since they must extend outwardly from the outermost beam of the bridge frame structure and support the debris shield and the debris at these outward positions. To support the wooden horizontal beam, prior art overhang falseworks also extend inwardly of the outermost I-beam to the I-beam adjacent to the outermost beam. This configuration helps the fastening system of the prior art overhang falsework handle the forces produced by the cantilever falsework design. As a result, the horizontal member of the prior art falsework must be sufficient in length to span two I-beams and to extend outwardly beyond the outer edge of the bridge deck a sufficient amount to provide support for the debris shield. In view of the horizontal member being a wooden 2"×6" or 2"×8", this beam structure is very heavy and awkward especially if it is made from side-by-side wooden beams. As a result, prior art falseworks are difficult for a single construction worker to maneuver and install. This is in view of the fact that the overhang falsework is connected to the bottom of the I-beam frame, which requires either scaffolding or the worker being suspended from the overhead bridge structure, etc. Accordingly, the prior art overhang falseworks can be difficult to install. However, the use of a wooden horizontal beam provides a good securing medium for the debris shield in that nails and/or screws can be quickly and easily set into the wooden beam to secure the base sheet of plywood thereto. By utilizing a wooden horizontal beam, the overhang falsework can be reused a number of times to securely hold the debris shield with these fasteners.

The upwardly extending portion of prior art overhang falseworks is also a wooden beam which is permanently attached to the horizontal member by any one of a number of fasteners including nails, screws and/or bolts. As with the horizontal member, the wooden upwardly extending member provides a good medium for either nailing or screwing the side sheet of the debris shield thereto. The upwardly extending member of the overhang falsework is typically a 2"×6" wooden beam. Permanently connecting the upwardly extending member to the horizontal member creates a rigid joint between the two members. However, it adds further weight to the already heavy horizontal member and the weight is concentrated at the outermost end of the falsework. This configuration makes the falsework unbalanced and even more difficult to maneuver. The resulting L-shaped configuration adds to these difficulties and makes the falsework difficult to store between uses.

SUMMARY OF THE INVENTION

In accordance with the present invention, an overhang falsework is provided for supporting a debris shield on a bridge frame during the construction and/or repair of the bridge which includes a multi-layered horizontal member construction and a removable upwardly extending member. In this respect, an overhang falsework in accordance with the present invention includes at least one metal layer for substantially supporting the loads on the overhang falsework and a wooden layer which provides a medium for quickly fastening the debris shield to the horizontal member. By utilizing this multi-layer structure for the horizontal beam, the cross-sectional height of the horizontal beam can be minimized and the weight can be minimized. Furthermore, the use of a metal layer in the horizontal member allows for a more robust clamping system to be attached thereto which makes the overhang falsework according to the present invention capable of being securely fastened to a single I-beam which further reduces the weight and size of the overhang falsework.

Another aspect of an overhang falsework according to the present invention is that an upwardly extending metal support can be rigidly connected to the metal layer of the horizontal member to support a selectively securable upwardly extending wooden member to which the side sheet of the debris-shield is attached. By providing a metal portion which extends only a few inches from the top of the horizontal member, the weight of the overhang falsework can be minimized during the installation of the falsework and also the storage capabilities of the overhang falsework are improved. The upwardly extending wooden member is selectively interengageable with the metal portion either before or after installation.

An overhang falsework according to yet another aspect of the present invention can utilize a replaceable wooden layer in the horizontal member so that after a number of uses, the wooden layer can be removed and replaced with a new wooden layer. As can be appreciated, after an overhang falsework is used many times, the wooden layer can be weakened due to weather and/or the use of fasteners. By utilizing a removable wooden portion, a weakened wooden layer can be replaced without discarding the entire frame structure of the falsework. In similar fashion, by including a selectively interengageable upwardly extending wooden member, it can also be replaced.

In accordance with even another aspect of the present invention, a clamping device is provided which is securely fastened or welded to the metal layer of the horizontal member. As a result, a single clamp attached to an I-beam can be utilized to adequately support the weight of the structure and the bending moment of the cantilever forces on the overhang falsework. The clamping device includes an outer portion which clamps to the outwardly facing bottom flange of the I-beam and an inward portion which clamps to the inwardly facing bottom flange. This in connection with the use of metal layers in the horizontal member, produces an overhang falsework frame structure which does not need to span multiple I-beams of the bridge frame structure.

It is accordingly an object of the present invention to provide an overhang falsework which can be easily and quickly connected to a bridge frame for supporting a debris shield.

Another object is the provision of an overhang falsework of the foregoing character that utilizes a multi-layer horizontal beam structure which is rigid yet lightweight.

Still another object is the provision of an overhang falsework of the foregoing character which can be securely connected to a single bridge I-beam.

A further object is the provision of an overhang falsework of the foregoing character wherein the horizontal member includes a non-metal or wooden layer which is used as a medium to fasten the debris shield to the horizontal member.

Yet a further object is the provision of an overhang falsework of the foregoing character wherein the non-metal or wooden layer is replaceable.

Still another object is the provision of an overhang falsework of the foregoing character which includes a clamping device rigidly secured to the metal portion of the horizontal member and capable of sufficiently supporting the cantilever loads on the overhang falsework.

A further object is the provision of an overhang falsework of the foregoing character which includes an upwardly extending support member securely fastened to the metal layer of the horizontal member for supporting an upwardly extending non-metal or wooden layer used for securing the side sheet of the debris shield.

Still another object is the provision of an overhang falsework of the foregoing character wherein the upwardly extending non-metal or wooden portion is selectively interengageable with the support member and is replaceable.

Yet another object is the provision of an overhang falsework of the foregoing character which utilizes components that are economical to manufacture, easy to use in the field and which are durable and resistant to the effects of the environment of its use.

BRIEF DESCRIPTION OF THE DRAWINGS

The foregoing objects, and others, will in part be obvious and in part be pointed out more fully hereinafter in connection with a written description of the preferred embodiments of the present invention illustrated in the accompanying drawings in which.

DESCRIPTION OF PREFERRED EMBODIMENTS

Figure 1:
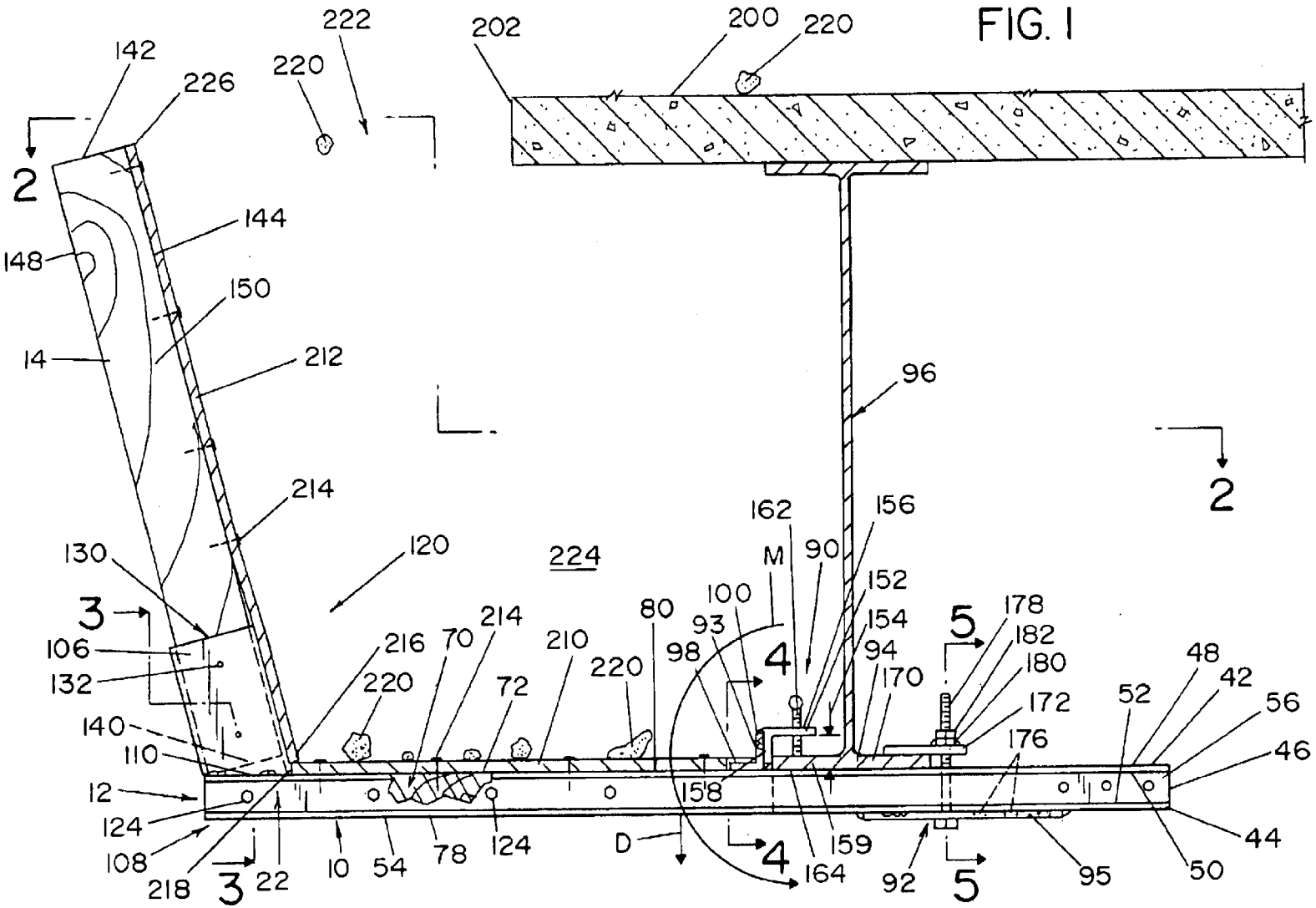
FIG. 1 is a cross-sectional elevational view of an overhang falsework in accordance with the present invention which includes a debris shield secured thereto and which is in the installed condition.

Referring now in greater detail to the drawings wherein the showings are for the purpose of illustrating preferred embodiments of the present invention only and not for the purpose of limiting the invention, FIGS. 3–6 show an overhang falsework 10 attached to I-beam 96 (see FIG. 1), having a horizontal or base member 12 and an upwardly extending member 14. Horizontal member 12 is a multi-component member which includes a first outer member 20 and a second outer member 22 which provide the majority of the structural integrity of the horizontal member. While member 12 is referred to as horizontal, it may not be exactly horizontal when in the installed condition. The angle of member 12 relative to true horizontal will be based on the configuration of the bottom of the I-beam 96. Outer members 20 and 22 are U-shaped metal beams which are spaced from one another and open away from one another. More particularly, member 20 has a top leg 24 having a top surface 26 and a bottom surface 28, a bottom leg 30 having a top surface 32 and bottom surface 34, and a web 36 joining top and bottom legs 24 and 30. Web 36 includes an outwardly facing surface 38 and an inwardly facing surface 40. In similar fashion, second outer member 22 includes a top leg 42, a bottom leg 44 and a web 46. Top leg 42 includes a top surface 48 and a bottom surface 50 and bottom leg 44 includes a top surface 52 and a bottom surface 54. Web 46 includes an outwardly facing surface 56 and an inwardly facing surface 58. First and second outer members 20 and 22 are joined together, which will be described in greater detail below, such that inwardly facing surfaces 40 and 58 of webs 36 and 46, respectively, face one another and are spaced from one another sufficiently to accept a non-metal layer or inner member 70 therebetween. Member 70 is preferably made from wood and is shown as a standard 2"×4". Member 70 has a cross-sectional configuration which is rectangular having a top surface 72, a bottom surface 74, and side surfaces 76, 78. Inner member 70 fits between outer members 20, and 22 such that web surface 40 faces side 76 and web surface 58 faces side 78 and top surface 72 along with surfaces 26 and 48 form portions of a horizontal member top surface 80 which will be discussed in greater detail below. While member 12 is shown as a wooden layer between two outwardly opened metal U-channels, other metal and wooden component configurations could be used. For example, the metal U-channels could be inwardly opened or an L-shaped metal component could replace at least one of the U-channels without departing from the invention of this application.

First and second outer members 20 and 22 are connected to one another in spaced relationship by several components of falsework 10 such that member or layer 70 is not necessary to maintain the spaced relationship between members 20 and 22. In this respect, overhang falsework 10 further includes an upper clamp bracket 90 and a lower clamp bracket 92 which are for selective interengagement with bottom flange 94 of an I-beam 96 as will be discussed in greater detail below. Upper bracket 90 includes an L-shaped bracket portion 93 having a base 98 and a vertical extension 100. Base 98 is preferably welded to both first and second top legs 24 and 42 which in part maintains the top of horizontal member 12 in the above described spaced relationship. Lower bracket 92 includes a base plate 95 which is welded to bottom legs 30 and 44 of members 20 and 22, respectively, thereby maintaining the bottom of horizontal member 12 in the above-described spaced relationship. Overhang falsework 10 further includes a tubular member or support 106 on the longitudinal outer end 108 of member 12. While member 106 is shown as being tubular, other types of supporting members could be used. Tubular member 106 is an upwardly extending tube having a bottom end 110 which is welded to legs 24 and 42 and further maintains the spaced relationship of members 20 and 22. It should be noted that while welding is the preferred joining method for these components, other joining methods known in the art could be used to attach these components to horizontal member 12. Tubular member 106 will be discussed in greater detail below.

While first and second members 20 and 22 provide a substantial portion of the structural strength of horizontal member 12, inner member 70 adds to the structural strength of member 12 and further provides a nailing or screwing surface for the attachment of the horizontal portion of a debris shield 120 to falsework 10. It is preferred that layer 70 is a standard wooden 2"×4" and it is therefore shown and described that way. However, other substrates which can work in connection with nails or screws can be utilized in accordance with the present invention. Wooden layer 70 is also selectively interengageable with members 20 and 22 so that it can be replaced, if necessary, due to overexposure to the elements, intensive use, and/or breakage. As stated above, member 70 fits between members 20 and 22. Member 70 is maintained relative to members 20 and 22 by several fasteners which are shown to be nuts 122 and bolts 124. However, other fasteners known in the art could be used. Once falsework 10 is in place, the horizontal portion of debris shield 120 can be easily nailed or screwed directly to member or layer 70. The result of this multi-layer structure according to the present invention, even though the height 126 of horizontal member 12 is only approximately four inches, is that the horizontal member has sufficient rigidity to support the weight of debris shield 120.

Tubular member 106 is used to secure upwardly extending member 14 relative to horizontal member 12. In this respect, as stated above, tubular member 106 is welded to members 20 and 22. Tubular member 106 includes upwardly facing opening 130 which is shaped to receive member 14 which is preferably a standard wooden 2"×6". However, other non-metal member of the same or different dimensions could be used. Member 14 includes a bottom end 140, a top end 142 and has a rectangular cross-sectional configuration with a first surface 144, a second surface 146, a third surface 148, and a fourth surface 150. Bottom end 140 is received by opening 130 and is selectively secured to tubular member 106 by fasteners in the form of nails 132. Other types of fasteners such as screws or bolts could be used to secure member 14 to member 106. As with wooden layer 70, upwardly extending member 14 provides a substrate for nailing or screwing the upwardly extending portion of debris shield 120 to falsework 10. Upward extending member 14 can also be replaced due to damage which includes but is not limited to extended wear, breakage or weathering. Furthermore, upper member 14 can be replaced if a different length is desired for the vertical or side portion of debris shield 120 which will be discussed in greater detail below. Yet another advantage of member 14 being removable is that it can be removed during the installation of falsework 10 to I-beam 96, thus to reduce the weight and awkwardness associated with having the weight of member 14 concentrated on the longitudinal outer end 108 of member 12.

Overhang falsework 10 is selectively securable to I-beam 96 by upper and clamp brackets 90 and 92, respectively. As is stated above, clamp bracket 90 includes L-shaped bracket 93 which is secured to first and second members 20 and 22. Clamp 90 further includes a second L-shaped bracket portion 152 having a vertical leg 158 which is secured to bracket 93 and a horizontal leg 156 which produces a gap 154 between top surface 80 and leg 156 sufficient to receive a range of outward portions 159 of flange 94. Leg 156 includes threaded holes 160 for receiving threaded fasteners 162. Clamp 90 interengages with flange portion 159 by the interengagement of fasteners 162 with the flange portion. Fasteners 162 can include a finger tightening head 164 or a head shaped to receive a tightening tool, not shown. In this respect, fasteners 162 turn in holes 160 and urge horizontal member 12 upwardly until flange portion 159 is tightly clamped between the bottom of fasteners 162 and at least a portion of horizontal member surface 80. Clamp 90 is the primary means of securing falsework 10 to I-beam 96 and supports the majority of the loads. More particularly, referring to FIG. 1, the downward load of members 12 and 14 along with debris shield 120 and debris thereon will impose a counterclockwise movement M and a downward force D on the horizontal member. Falsework 10 is maintained relative to I-beam 96 by the interengagement fasteners 162 of clamp 90 along with the engagement between surface 80 and the bottom surface 164 of flange 94.

Lower clamp bracket 92 is primarily designed to insure that the interengagement between clamp 90 and outward flange portion 159 is maintained. Bracket 92 interengages with an inward flange portion 170 of flange 94 and prevents falsework 10 from moving relative to I-beam 96 in an outward direction. Since clamp 90 uses clamping pressure to support falsework 10 and no modifications are made to flange 159, fasteners 162 are in engagement with a flat surface. Lower clamp bracket 92, by preventing outward movement, prevents clamp 90 from sliding longitudinally off of flange portion 159. As stated above, bracket base plate 95 is rigidly secured to members 20 and 22. Even though base plate 95 is shown welded to bottom legs 30 and 44, plate 95 could be secured between members 20 and 22 in gap 171. Clamp 92 further includes a stop plate 172, a bolt 178 and nuts 180 and 182. Due to the numerous I-beam configurations and sizes, particularly with respect to the length of flange 94, base plate 95 extends longitudinally along members 20 and 22 and includes several securing holes 176. When falsework 10 is attached to I-beam 96, the user first positions clamp 90 on outer flange 159 and then chooses the particular attachment hole 176 which allows bolts 180 to extend through base plate 95, gap 171, horizontal member 12 and past, but close to, inward flange portion 170. Stop plate 172, which includes nut 180 welded thereto, is then threaded to bolt 178 by turning the bolt. Once bolt 178 is tightened sufficiently to pull stop plate 172 against flange portion 170, lock nut 182 is then tightened onto bolt 178 against nut 180 to prevent clamp 92 from loosening. With this type of installation configuration, clamp 90 provides the support of overhang falsework 10 and clamp 92 prevents clamp 90 from moving relative to flange 94 so that clamp 90 maintains its interengagement with the flange.

Figure 2:
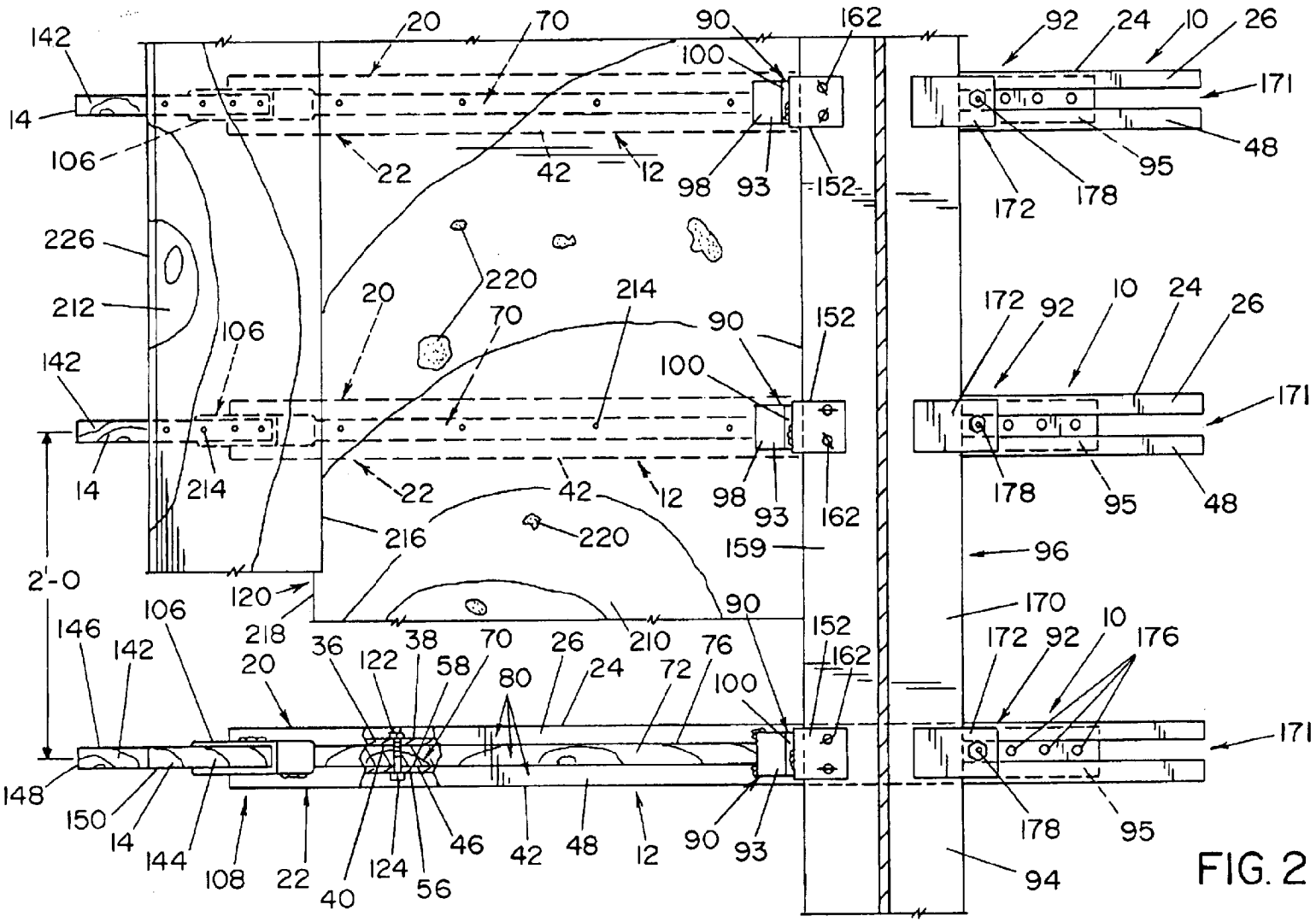
FIG. 2 is a partially sectioned top view taken along line 2—2 in FIG. 1 and shows three overhang falseworks according to the present invention which are supporting a debris shield and which are in the installed condition.
Figure 3:
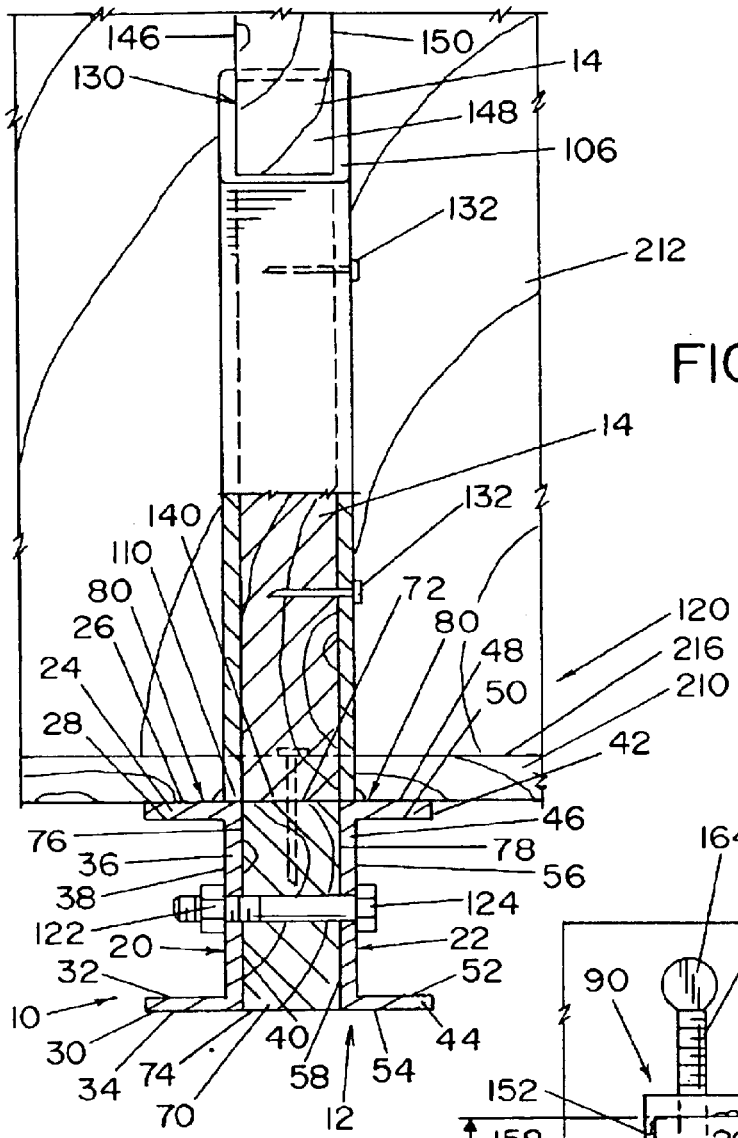
FIG. 3 is an enlarged sectional elevational view taken along line 3—3 in FIG. 1.
Figure 4:
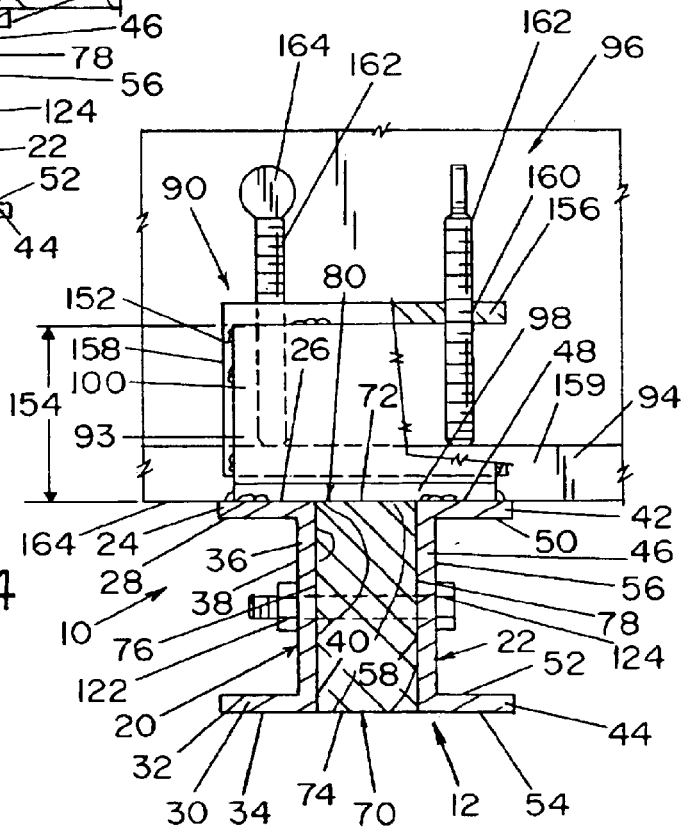
FIG. 4 is a sectional elevational view taken along 4—4 in FIG. 1.
Figure 5:
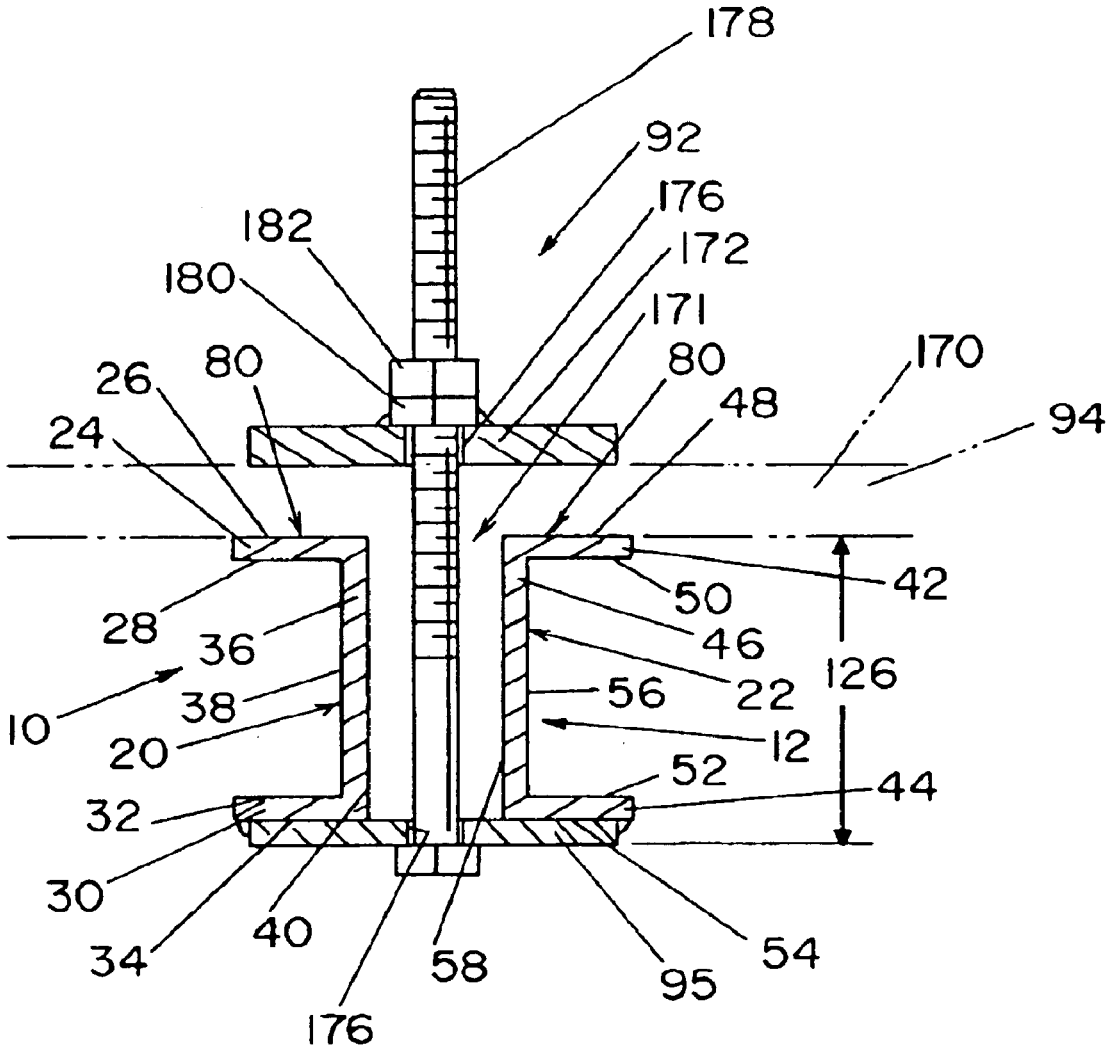
FIG. 5 is a sectional elevational view taken along 5—5 in FIG. 1.
Figure 6:
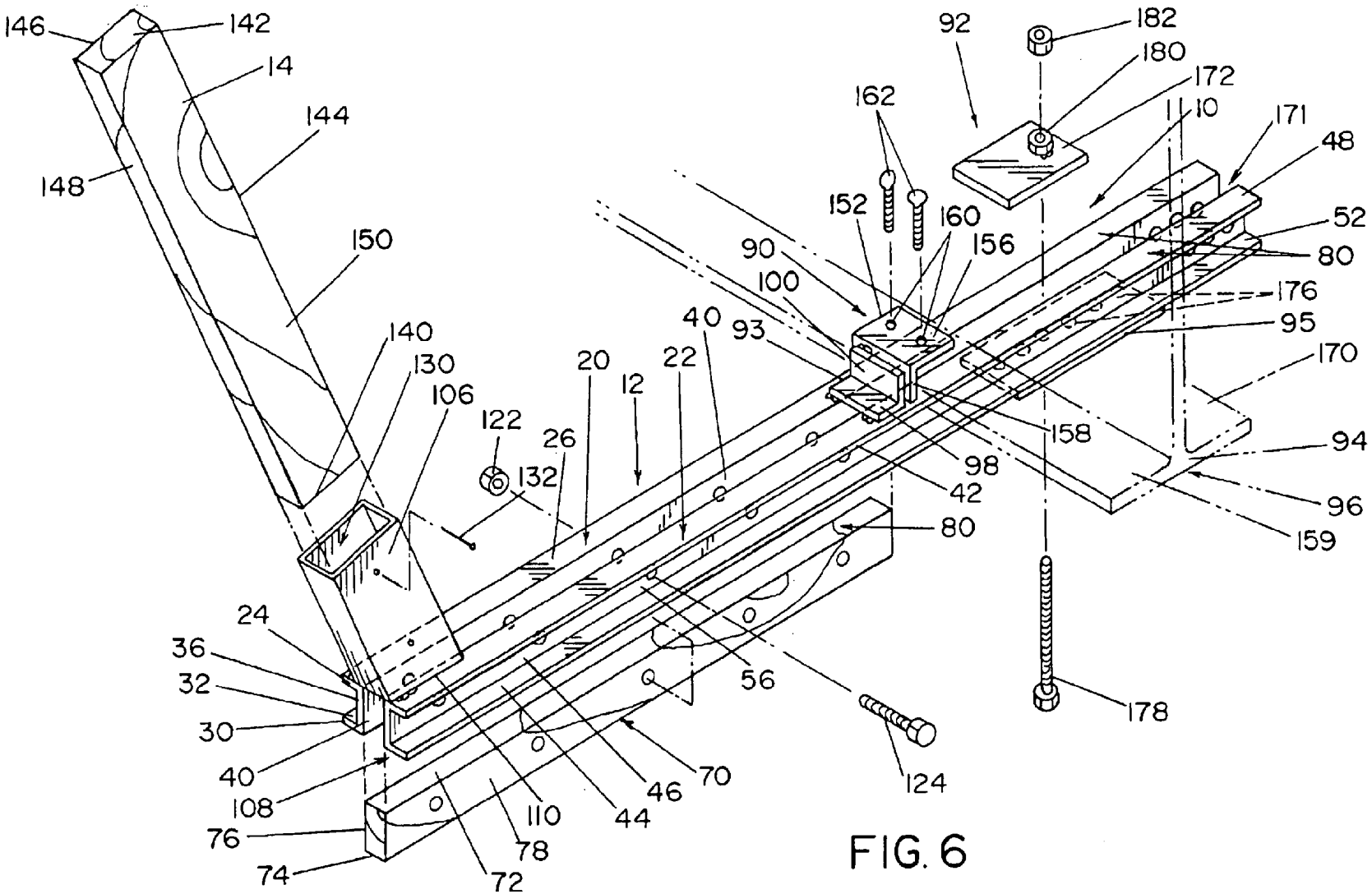
FIG. 6 is an exploded perspective view of the overhang falsework shown in FIG. 1.

Referring to FIGS. 1 and 2, three overhang falseworks 10 are shown in an installed condition with debris shield 120. More particularly, a plurality of overhang falseworks 10 are first installed on the outermost I-beam 96 of a bridge frame structure which supports a bridge deck 200 having an outer edge 202. While particular reference is made to bridge frame structures, it should be noted that the overhang falsework of the present invention can be used on a wide variety of other frame structures and therefore this invention should not be limited to bridge frames. Due to the temporary nature of overhang falseworks, it is important that they can be quickly installed and removed from the bridge frame. Further, it is also important that the bridge frame need not be modified for the installation of the falsework or damaged by the installation of the falsework. Accordingly, as described above, each overhang falsework is clamped to bottom flange 94 of the I-beam. Overhang falseworks 10 are positioned along the bridge frame at a preferred spacing of two feet and once installed, the debris shield is attached thereto. Debris shield 120 includes a base sheet 210 and a side sheet 212 which extends along the I-beam frame structure. It is preferred that base and side sheets 210 and 212 are ¾ inch sheets of laminated plywood which are cut longitudinally based on the size of the debris shield desired and the size of overhang falsework 10. Base and side sheets 210 and 212 extend transversely to falsework 10 and are supported by more than one falsework 10. While it is preferred that a two foot spacing is used, the spacing is dictated by the strength of the falsework, the strength of base and side sheets 210 and 212, and the type and amount of debris expected.

Turning to base sheet 210, it is secured to horizontal member 12 by fasteners 214 which extend through base sheet 210 into wooden layer or member 70. Fasteners 214 can be either nails or screws or any other fasteners known in the art for securing an object to a wooden substrate. By providing a multi-layer horizontal layer, member 12 has both the advantage of lightweight, compact and rigid steel frame design and the advantage of a substrate capable of receiving fasteners which can be quickly installed and removed. With respect to the quick installation of fasteners 214, by utilizing a wooden layer in member 12, the worker installing the debris shield does not need to aim for a particular hole or fastening point which is typically necessary for temporarily securing an object to a metal substrate, but must only aim the fastener in general manner to engage wooden layer 70. This allows for use of powered fastening equipment for the installation of fasteners 214. In addition, when it is time to remove falsework 10 from the bridge frame structure, fasteners 214 can be quickly removed with techniques known in the art.

Side sheet 212 is attached to upward member 14 in similar fashion as the base sheet and, therefore, the portions which are similar will not be discussed in detail. As set forth above, upward member 14 does not need to be secured to horizontal member 12 when falsework 10 is attached to I-beam 96. Accordingly, if falsework 10 is attached to I-beam 96 without upward member 14 in place, after installation, the worker then positions upward member 14 into tubular member 106 by inserting bottom end 140 into opening 130. Then, upward member 14 is secured to tubular member 106 by fasteners 132. Once secured, side sheet 212 is positioned against upward member 14 such that its bottom edge 216 rests on or near outer edge 218 of base sheet 210 and then the side sheet is secured to upward member 14 by fasteners 214. Once in place, side sheet 212 acts as an outer barrier for debris 220 which falls from bridge deck 200. Side sheet is spaced outwardly from deck edge 202 so as to provide an entry channel 222 for debris 220 to enter into the debris containment zone 224. Based on the job being performed on bridge deck 200, side sheet 212 can be configured so that its top edge 226 extends above bridge deck 200 to further define entry channel 222. As is shown in FIG. 1, top edge 224 of side sheet 212 can also be at approximately the same height as bridge deck 200. Furthermore, side sheet edge 224 can also extend upwardly beyond top 142 of upwardly extending member 14.

Once the construction project is complete, the debris contained within containment area 224 is removed. Then base and side sheets 210 and 212 are removed from falsework 10 and finally falseworks 10 are removed from I-beam 96 to be used in a subsequent construction project.

While considerable emphasis has been placed on the preferred embodiments of the invention illustrated and described herein, it will be appreciated that other embodiments can be made and that many changes can be made in the preferred embodiments without departing from the principles of the invention. Accordingly, it is to be distinctly understood that the foregoing descriptive matter is to be interpreted merely as illustrative of the invention and not as a limitation.

What is claimed is:

1. An overhand falsework for supporting a debris shield on an I-beam, said falsework comprising an elongated member extending transverse to the I-beam and having an inner end adjacent the I-beam and an outer end spaced therefrom, a clamp on said member between said inner and outer ends for selectively securing said member to the I-beam, said member having a metal component extending between said inner and outer ends and a non-metal component extending at least partially between said inner and outer ends and secured to said metal component, said non-metal component is a wooden layer, said metal component is a first metal component and said member further includes a second metal component, said wooden component being between said first and second metal components, and said first and second metal components have U-shaped cross-sectional configurations which open away from each other.

2. An overhang falsework for supporting a debris shield on an I-beam, said falsework comprising an elongated member extending transverse to the I-beam and having an inner end adjacent the I-beam and an outer end spaced therefrom, a clamp on said member between said inner and outer ends for selectively securing said member to the I-beam, and said member having a metal component extending between said inner and outer ends and a non-metal component extending at least partially between said inner and outer ends and secured to said metal component, said metal component is a first metal component and said member further includes a second metal component, said non-metal component being between said first and second metal components, and said first and second metal components have U-shaped cross-sectional configurations which open away from each other.

3. An overhang falsework for supporting a debris shield on an I-beam, said falsework comprising an elongated member extending transverse to the I-beam and having an inner end adjacent the I-beam and an outer end spaced therefrom, a clamp on said member between said inner and outer ends for selectively securing said member to the I-beam, said member having a metal component extending between said inner and outer ends and a non-metal component extending at least partially between said inner and outer ends and secured to said metal component, and the I-beam has a bottom side and said member has a top side and a bottom side, said metal component being a first metal component and said member further including a second metal component, said non-metal component having oppositely facing sides extending in said longitudinal direction, said first metal component having a first side extending in said longitudinal direction which engages one of said oppositely facing sides, and said second metal component having a second side extending in said longitudinal direction which engages the other of said oppositely facing sides.

4. The overhang falsework according to claim 3, wherein said first and second metal components and said non-metal component extend between said top and bottom sides of said member.

5. The overhang falsework according to claim 4, wherein said non-metal component is a wooden layer.

6. The overhang falsework according to claim 4, wherein said member is a base member and said falsework further includes an upwardly extending member near said outer end, said upwardly extending member including a non-metal portion.

7. The overhang falsework according to claim 6, wherein said upwardly extending member includes a metal support connected to said base member near said outer end and said non-metal portion is secured to said metal support.

* * * * *